United States Patent [19]

Magi

[11] 4,323,090

[45] Apr. 6, 1982

[54] APPARATUS FOR AERATING LIQUIDS

[75] Inventor: Hugo Magi, Unionville, Canada

[73] Assignee: Bronardi Inc., Markham, Canada

[21] Appl. No.: 151,528

[22] Filed: May 19, 1980

[51] Int. Cl.[3] ..... B65B 55/00; C02D 1/00

[52] U.S. Cl. ..... 141/70; 141/285; 141/279; 222/397; 261/64 R; 261/65; 261/DIG. 7

[58] Field of Search ..... 141/4–8, 141/37, 39–67, 250–284, 285–310, 231–233, 312, 382–388, 392, 69, 70; 222/129.1, 129.2, 165, 325, 396, 397, 399; 261/DIG. 7, 64 R, 65

[56] References Cited

U.S. PATENT DOCUMENTS 3,534,788 10/1970 Vergobbi et al. ..... 141/287

*Primary Examiner*—Houston S. Bell, Jr.

*Attorney, Agent, or Firm*—Dennison, Meserole, Pollack & Scheiner

[57] ABSTRACT

The invention provides an improved structure for aerating potable liquids used in the preparation of drinks. The structure includes a movable part which provides access for a container; a pneumatic seal arrangement engageable with the container, a traveller arranged to allow the movable part to move vertically; and a control system for supplying compressed carbon dioxide to the seal and to the liquid in the container.

18 Claims, 12 Drawing Figures

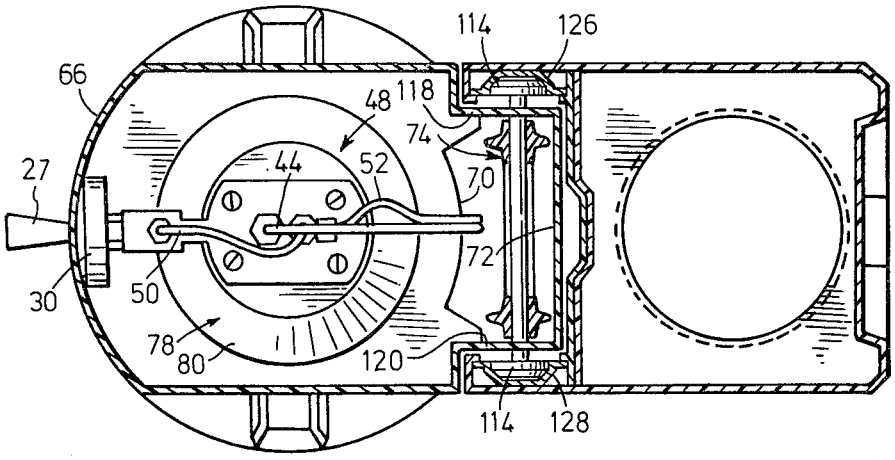
FIG. 5
FIG. 6
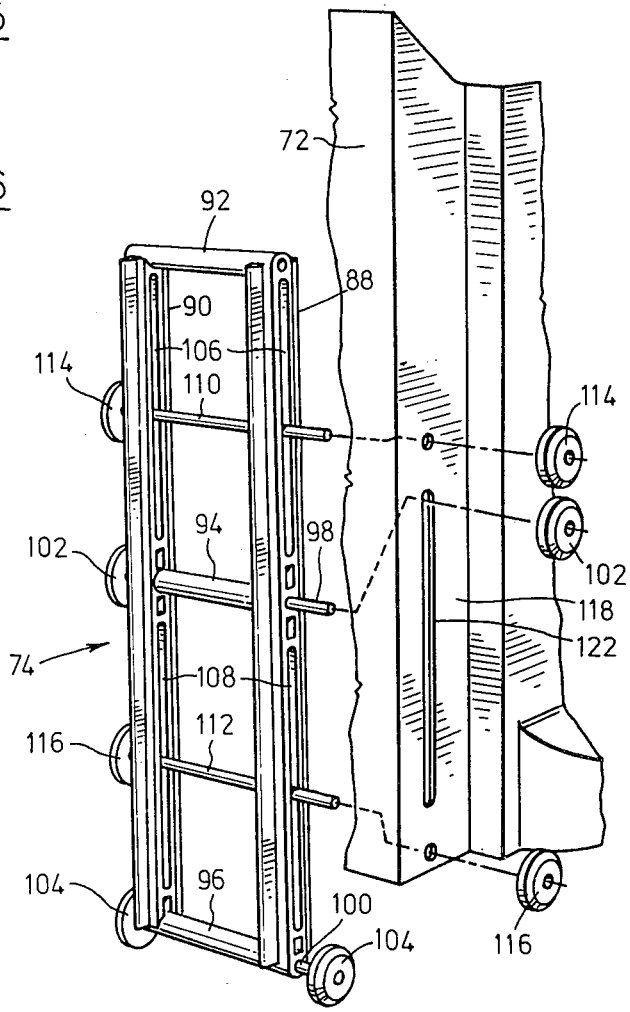

FIG. 8
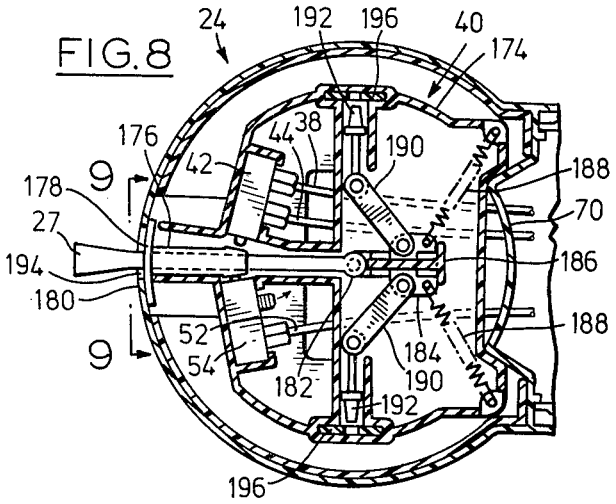
FIG. 10
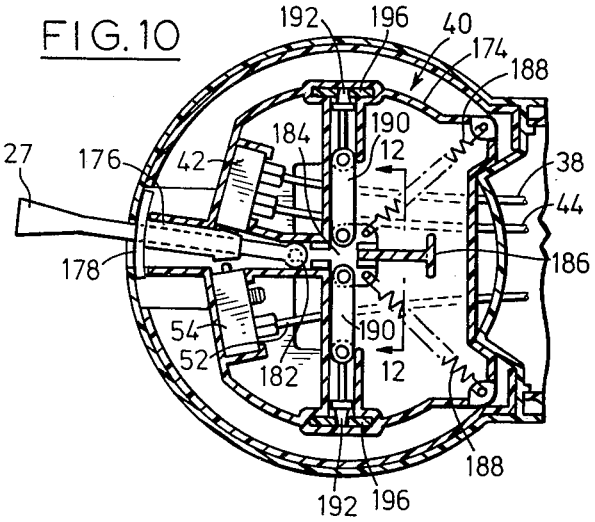
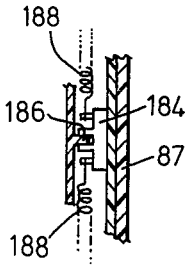
FIG. 12
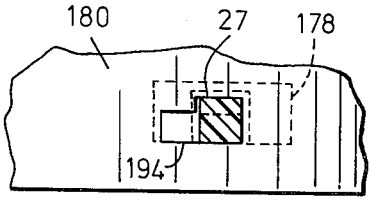
FIG. 9
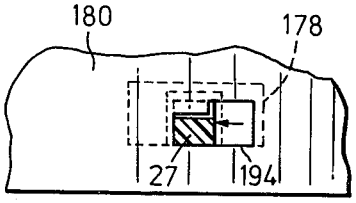
FIG. 11

APPARATUS FOR AERATING LIQUIDS

This invention relates to a structure for use in aerating potable liquids in a container and particularly for aerating water which is being used to make a drink containing a flavoured additive.

Aerated non-alcoholic beverages are commonly referred to as "soft drinks" and are shipped from the source to retail outlets for consumer use in bottles or cans. The cost to the consumer is dependent in part on the cost of transporting the product and also on either the cost of the container, in the case of non-returnable bottles and cans, or on the handling cost associated with returning empty bottles for subsequent further use. The present climate of public opinion dictates a strong trend towards returnable containers to reduce pollution problems and to conserve materials. This trend must result in increased costs for soft drinks due to the labour requirements associated with the returning procedure.

One approach to reducing the cost to the consumer is to provide a concentrate for use in water. Although there is a market for this product, consumers generally consider such a "flat" drink to be a poor substitute for an aerated beverage or soft drink.

Soft drinks have been provided in the home using flavoured concentrate which can be mixed with water and which is then aerated using carbon dioxide from a pressurized container. Structures suitable for performing this operation must satisfy several important criteria. Firstly the structure should receive a bottle or other suitable container, seal the bottle and aerate the contents. The bottle should be easily but accurately located in the structure and be contained during aeration to avoid accidents caused by explosion of a defective bottle. Evidently during aeration the user should not be able to remove the bottle until pressure has been discharged from the bottle.

It is also desirable that the structure permit the user to aerate the liquid to taste using simple controls and that for economic reasons the carbon dioxide be used efficiently. Other important considerations are that the structure be appealing to the eye and readily maintained by the user.

One attempt to provide a suitable structure for aerating liquids is shown in U.S. Pat. No. 3,953,550 to Gilbey. Although the structure shown in this patent gained some acceptance in the market place it suffered from some disadvantages. Notably the bottle of liquid is sealed by operating a lever to apply a mechanical force. The structure must be anchored to permit applying this force which may be too demanding for a child. Another disadvantage of the Gilbey structure is that the bottle must be angled into a receiver blindly. The liquid could be spilled and the user has no visual indication of proper location of the bottle. On removing the bottle, it is angled outwardly without bottom support so that it is quite likely that the bottle will be dropped, particularly by someone who does not use the structure regularly.

The present invention provides an improved structure for aeration of liquids which overcomes the disadvantages of prior art structures.

The invention will be better understood with reference to the following description taken in combination with the accompanying drawings, in which:

FIG. 5 is a top sectional view on line 5—5 of FIG. 3;

FIG. 6 is an exploded perspective view showing a traveller used in combination with the movable front part to permit movement of this part between the elevated position shown in FIG. 4 and the lowered position shown in FIG. 3, and a portion of the front part viewed from above and to the right of FIG. 5;

FIG. 8 is a top sectional view taken generally on line 8—8 of FIG. 3 and illustrating parts of a controller associated with the pneumatic system and shown in a first position allowing engagement of a bottle into the structure;

FIG. 9 is a side view on line 9—9 of FIG. 8 and illustrating the position of a control arm;

FIG. 10 is a view similar to FIG. 8 and illustrating the controller in a second position where the bottle would be retained in the structure for aeration to take place;

FIG. 11 is a view similar to FIG. 9 and showing the control arm in the position shown in FIG. 10; and FIG. 12 is a side view on line 12—12 of FIG. 10 and showing some of the detail of the controller.

Figure 1:
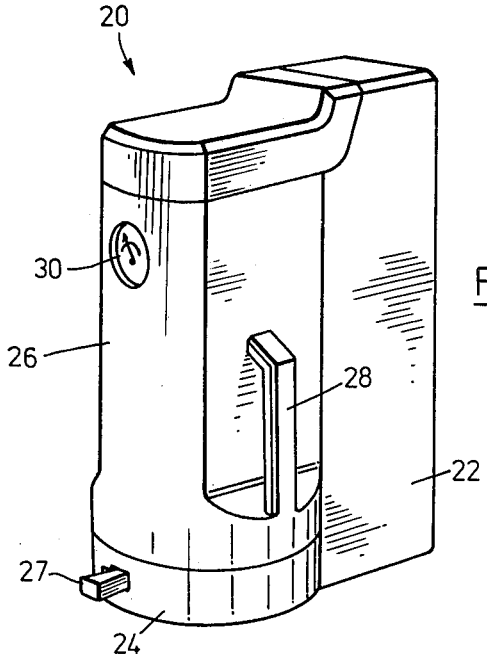
FIG. 1 is a perspective front view of a preferred embodiment of a structure for aerating potable liquids in a bottle, and particularly water containing a flavouring.

The structure designated generally by the numeral 20 shown in FIG. 1 represents a preferred embodiment of apparatus for aerating liquids according to the invention. As seen in FIG. 1 the apparatus includes a stationary rear portion 22 having a forwardly projecting base portion 24 containing a controller having a control arm 27. Above the base portion 24, a movable front part 26 can be elevated vertically for engaging a bottle containing the liquid and then returned to the position shown in FIG. 1 for aeration of the liquid. A pair of side handles 28 (one of which can be seen in FIG. 1) are provided for moving the part 26 vertically and an aeration indicator 30 is provided for selecting the proper aeration required in the liquid for the specific flavour chosen!

The general arrangement of the structure will be described initially followed by description of FIG. 7 which shows a connector assembly used to engage the top of the bottle, and a controller associated with control arm 26 will then be described with reference to FIGS. 8 to 12.

Figure 2:
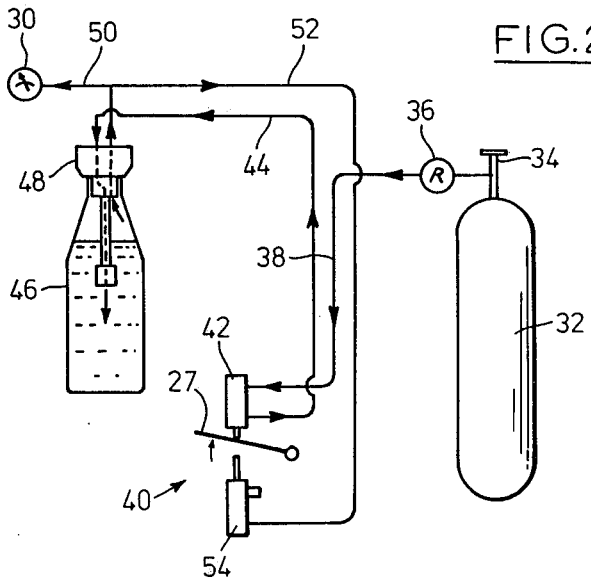
FIG. 2 is a schematic arrangement of a pneumatic system used in the apparatus.

Reference is next made to FIG. 2 which illustrates a pneumatic system used in the structure. The pneumatic system controls the flow of carbon dioxide to the liquid to be aerated and receives carbon dioxide from a replaceable pressurized container 32 by way of a tap 34 and pressure regulator 36 which is normally set to about 175 p.s.i. Flow continues from the regulator by way of tubing 38 to the controller 40 which includes control arm 27. With the arm 27 in the position shown, carbon dioxide enters a valve 42 and then proceeds through tubing 44 to enter a bottle 46 by way of a connector assembly 48. As pressure builds up, the pressure in tubing 50 and 52 increases to give a reading on the aeration indicator 30.

In the arrangement shown in FIG. 2, the tubing 52 leads to a closed valve 54. However after aeration, the arm 27 is moved into engagement with valve 54 thereby allowing valve 42 to return to a closed position sealing off the supply of carbon dioxide from tubing 38 and opening valve 54 which then allows exhaustion to atmosphere from the tubing 50 and 52 as well as from the bottle 46. As will be described subsequently, the bottle can then be removed.

As already mentioned, the connector assembly 48 will be described more fully with reference to FIG. 7 and the controller 40 and its mechanical parts will be described with reference to FIGS. 8 to 12. This will follow description of the front part 26 in locating a bottle in the apparatus for aeration.

Figure 3:
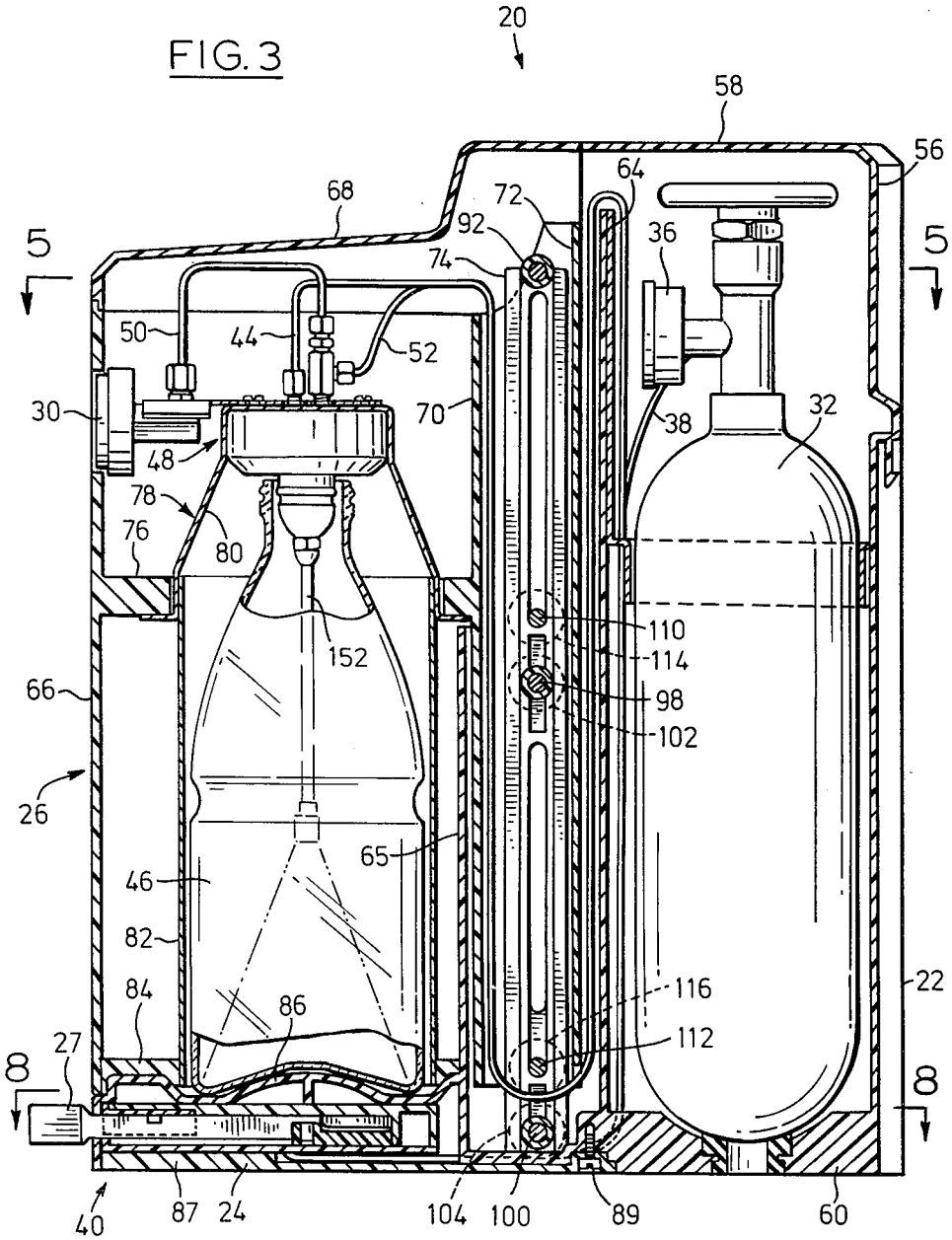
FIG. 3 is a sectional side view of the apparatus in the position shown in FIG. 1 and showing the bottle in place.

As seen in FIG. 3, the gas container 32 is located in the stationary rear portion 22 of the structure 20. All of the tubing seen in FIG. 2 is not apparent in FIG. 3 but it will be appreciated that tubing 38 leading from the regulator 36 couples the container 32 to the controller 40 contained in the base portion 24 of the rear portion 22. Similarly, tubing between the controller 40 and the connector assembly 48 can be seen in part in this view. The arrangement of the tubing is such that the front portion 26 can move between the lowered or normal position shown in FIG. 3 to the elevated position shown in FIG. 4.

As seen in FIGS. 3 and 5, the rear portion 22 includes an exposed outer wall 56, a top 58, and a base 60. The forwardly projecting base portion 24 is moulded integrally with the rear portion 22. These portions include a partition 64 which combines with the wall 56 to restrain the container 32 in position, and a partition 65 which covers traveller 74 when the front portion is in the elevated position. The bottom 60 is shaped to resiliently support the container 32.

The movable front portion 26 also includes an exposed wall 66, a contoured top 68, and a pair of partitions 70, 72 which are generally parallel to the partition 64 of the rear portion 22. Traveller 74 (see also FIG. 6) is positioned between the partitions 70, 72 and engaged with the rear portion as will be described. This traveller provides interengagement between the movable front portion 26 and the rear portion 22 so that the front portion can be lifted vertically to the elevated position shown in FIG. 4 and it is then supported by the traveller 74.

The movable front portion 26 also includes an integral upper flange 76 formed internally for supporting a steel shroud 78 having an upper part 80 formed for engagement with the flange 76 and for retaining the connector assembly 48. A lower part 82 of the shroud extends downwardly about the bottle 46 terminating in a lower flange 84 formed separately and subsequently attached to the wall of the front part. In the position shown in FIG. 3 the bottle 46 is resting on a contoured top 86 of the base portion 24, above the controller 40 which is retained by a bottom cover 87 attached by screws 89 (one of which is seen). The top 86 is also shaped to locate the lower end of the front portion 26.

As seen in FIGS. 3 and 5, the connector assembly 48, aeration indicator 30, and associated tubing and fittings are all suspended from the metal safety shroud 80 with the indicator located in the wall 66 of the front part 26.

Returning to the traveller 74, this can be seen in more detail in FIG. 6. The traveller consists of a pair of side elements 88, 90 connected by integral upper, intermediate and lower cross members 92, 94 and 96. These cross members contain respective rods 98, 100 acting as axles for respective pairs of wheels 102, 104.

The side elements 88, 90 define respective pairs of upper and lower slots 106, 108 providing guidance for respective rods 110, 112 which carry pairs of wheels 114, 116.

Figure 4:
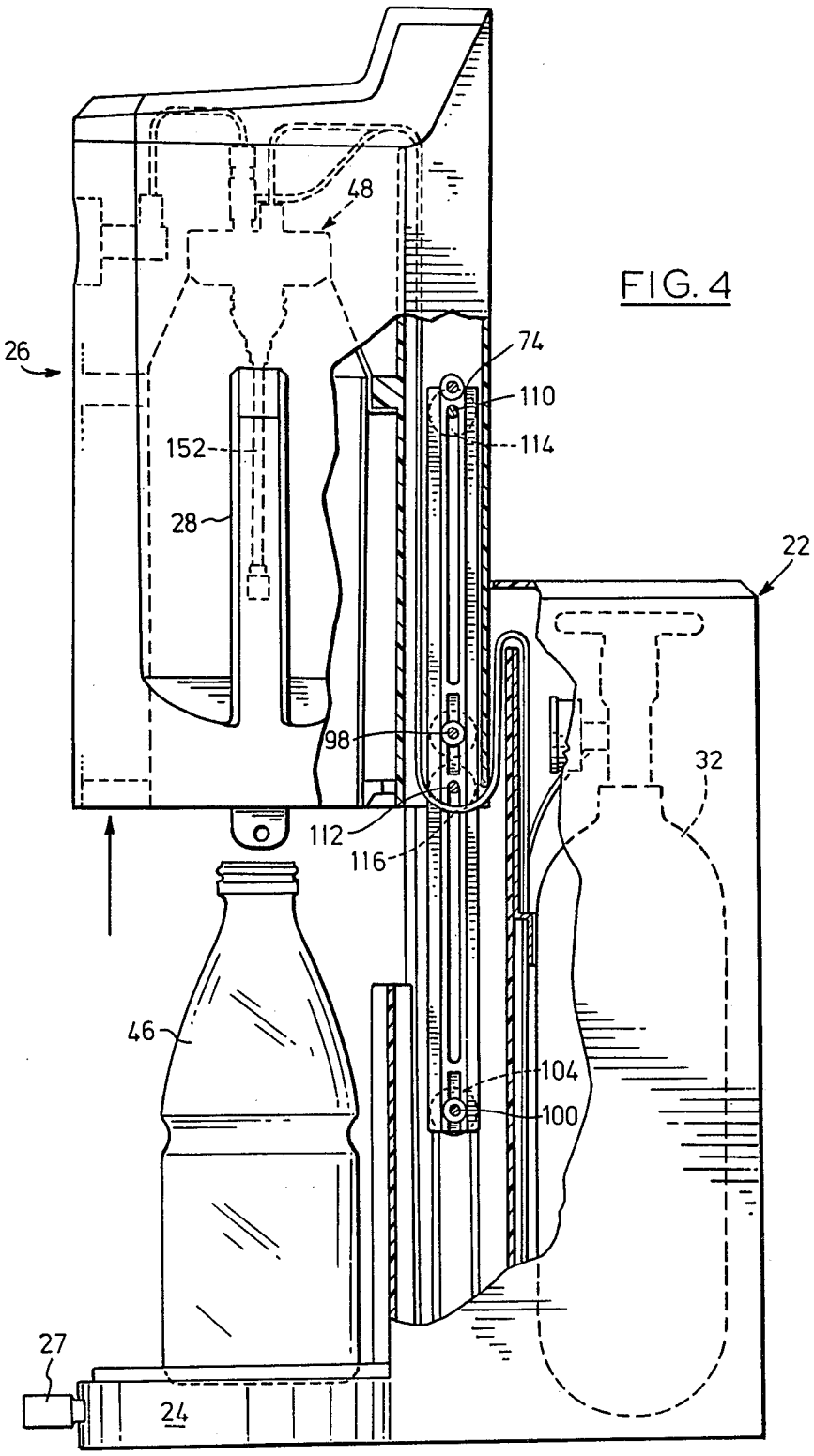
FIG. 4 is also a side view having parts broken away and showing a movable front part in an elevated position providing access for placing a bottle in the apparatus.

It will be seen from FIG. 5, that the main body of the traveller is contained between the partitions 70, 72 of the front part and between recessed portions 118, 120 of the wall 66. The rods associated with the wheels shown in FIG. 6 project through the walls 118, 120 in a manner illustrated in FIG. 6 with reference to the wall 118. Here it will be seen that the wall 118 includes an elongated vertical slot 122 which corresponds to a similar slot in the wall 120. As seen in FIG. 6, it will be evident that when the front part 26 is lifted vertically, the wheel 116 will move with the front portion so that the rod 112 slides in the slots 108. Similarly, the wheels 114 will move with the front portion carrying the rod 110 in the slots 106 so that during initial movement, the body of the traveller will remain stationary until such time as the rods 110, 112 meet the upper extremities of the respective slots 106, 108. At this point further upward movement of the front portion will carry the traveller supported by the rods 110, 112 and this upward movement will continue until the front portion reaches the upper extremity of its travel. As seen in FIG. 5, this upward movement is made possible by carrying the wheels in pairs of tracks 126, 128 which are set inside the rear portion in sections created for this purpose. As seen in FIG. 4, with the front portion in the elevated position, the traveller is in its uppermost position supporting the front portion.

In effect the traveller provides lost motion while the wheels carrying rods 110, 112 move to the point where the traveller is carried by these rods. At this point the traveller projects below the front portion and into the rear portion and the upward movement of the front portion carries the traveller into the position shown in FIG. 4 to provide positive guidance for the front portion regardless of the fact that the front portion is almost disengaged from the rear or stationary portion. Upon lowering the front portion, the traveller will provide continuous guidance until the structure returns to the position illustrated in FIG. 3.

Figure 7:
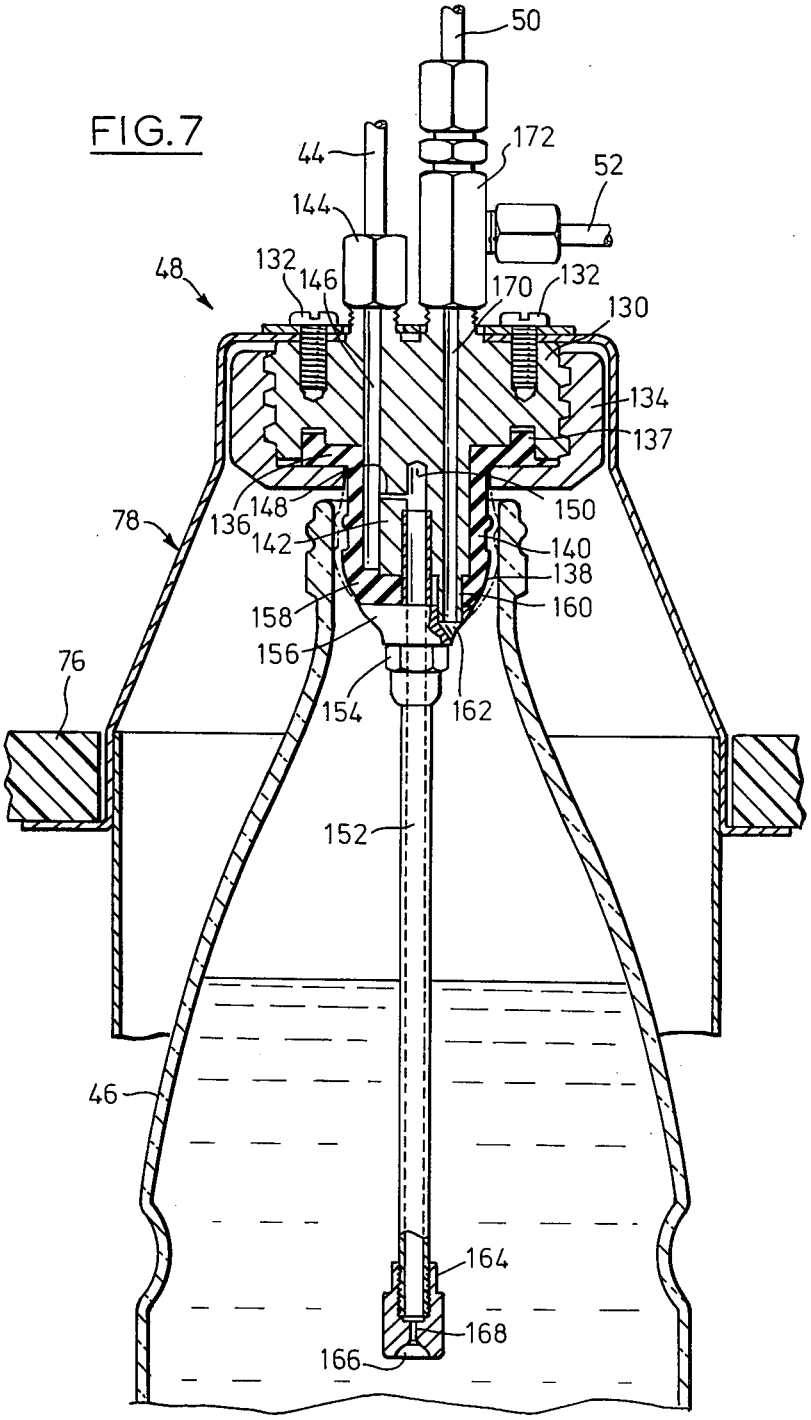
FIG. 7 is a sectional view drawn to a larger scale and illustrating the connector assembly used in making a gas-tight seal with the bottle.

Reference is next made to FIG. 7 to describe the connector assembly 48 which is shown in this figure to a larger scale than that used in the previous drawings. The connector assembly 48 includes a first element 130 attached by screws 132 to a top of the shroud 78 and is threaded on its outer cylindrical surface to receive a second or retaining element 134. This element combines with the element 130 to retain a flange 136 having a locating rib 137. This flange is part of a sealing member 138 which has a cylindrical portion 140 extending downwardly from the flange 136 and about a downward cylindrical projection 142 of the first part 130. The cylindrical portion 140 is a loose fit within the neck of the bottle 46 and includes outwardly projecting ribs which are brought into engagement with the inside of the bottle for sealing the bottle as will be described.

As also seen in FIG. 7, tubing 44 which leads from controller 40 (see FIG. 2) carries compressed carbon dioxide through a connector 144 to an inlet 146 in the first element 130. This inlet is in communication with the inner surface of the cylindrical portion 140 for providing pressure behind the portion 140 to cause distortion into contact with the inside surface of the bottle.

Also, the inlet 146 leads to a smaller diameter bore 148 which communicates with a central opening 150 in the cylindrical projection 142. This opening is machined to receive a threaded upper end portion of a delivery tube 152 which projects downwardly into the bottle 46. The tube 152 has a nut 154 attached permanently to it for use in tightening the tube into the opening 150 and a washer 156 is provided between the nut 154 and a bottom wall 158 of the sealing member 138. This wall includes two openings, one for the tube 152 and a second for a cylindrical projection 160 which projects beyond the wall and enters an opening 162 in the washer 156 for venting purposes as will be described. It will be evident that during assembly care must be taken to position the washer so that the projection 160 is engaged in the opening 162.

The delivery tube 152 projects downwardly into the bottle terminating at a spray head 164. This head is threaded onto the end of the tube and includes a generally spherical end depression 166 communicating with an orifice 168 which leads compressed gas from the end of the tube 152. The spray head is capable of projecting a conical pattern of sprayed carbon dioxide into the liquid contained in the bottle. This spray pattern is indicated in ghost outline in FIG. 3 where it will be seen that the angle of the cone is dictated by the height of the spray head from the bottom of the bottle and the diameter of the bottle so that in effect a generator of the cone is a line drawn from the spray head to the junction of the bottom and side wall of the bottle.

Returning to FIG. 7, when the controller 40 is used to release carbon dioxide under pressure into the tubing 44, there is a pressure build up in the inlet 146 which is to some extent throttled by the bore 148. In effect the pressure in the inlet 146 will be substantially that of the pressure regulator 36 (FIG. 2) and this will cause an outward distortion of the cylindrical portion 140 of the sealing member 138. Such a distortion is shown in ghost outline where it will be seen that ribbing on the outside of the cylindrical portion engages an inside surface of the bottle thereby sealing the bottle. Carbon dioxide will bleed through the bore 148 and into the delivery tube 152 before being sprayed from the head 164 into the contents of the bottle. As spraying continues, there will be a pressure build up in the bottle with the air trapped above the liquid acting as an accumulator. The pressure in the bottle will be transmitted through opening 162 in the washer 156 and then into an outlet 170 leading into a T-fitting 172 and then to tubing 52 and 50. As described with reference to FIG. 2, the tubing 50 leads to a pressure indicator which is graduated in some simple manner to indicate levels of aeration so that the user can aerate the liquid to a level corresponding to that recommended for the chosen drink. The user then allows gas to enter the liquid until the needle on the indicator reaches the recommended level, and then the user will deactivate the aeration as will be described more fully with reference to FIGS. 8 to 12. Once this is done, the tubing 52 leads to atmosphere thereby allowing the pressure buildup in the bottle and the inlet 146 to dissipate. The sealing member 138 will then collapse into the position shown in FIG. 7 so that the bottle can be withdrawn by first moving the movable front portion 26 into the position shown in FIG. 4.

The level of the liquid in the bottle should not be too high otherwise the accumulator action of the air trapped in the bottle will be lost. It is envisaged that the bottle will be provided with an indicator line to ensure that the bottle is not completely filled.

The controller 40 (FIGS. 2 and 3) will now be described with reference to the use of the structure in aerating a bottle of liquid which is preferably water. Flavoured concentrate would then be added. Although some flavourings could be added before aeration, at the present time most commercially available flavourings would be added after aeration.

As seen in FIG. 8, the controller 40 is housed within the base portion 24 and is essentially a self-contained unit to permit replacement. Housing 174 is shaped to locate the stationary parts of the controller and to guide some of the moving parts. The valves 42 and 54 are located to either side of the control arm 27 which is positioned in a sleeve 176 having an arcuate flange 178 trapped between the housing 174 and an outer wall 180 of the base portion 24. As will be described, this flange guides the sleeve for movement on a inner surface of the wall 180.

The inner end of the control arm 27 terminates at a pin joint 182 where the arm meets a block 184 arranged for sliding movement in a guide 186. The block is biased towards the position shown in FIG. 8 by a pair of tensioned springs 188 attached at their other ends to suitable mountings in the housing 174. The block is also coupled by suitable pin joints to a pair of links 190 which are attached at their respective opposite ends to plungers 192 guided for motion along a common line of action but in opposite directions. It will be evident from the arrangement shown in FIG. 8 that outward movement of the control arm 27 will draw the block 184 to the left (as drawn) thereby causing the links 190 to push the plungers 192 outwardly. The position shown in FIG. 8 corresponds to the situation in which a user is about to load the structure. The user is free to lift the movable front portion into the position shown in FIG. 4 to load the bottle. With the bottle in position, the movable front portion 26 is lowered into the FIG. 3 position and the structure is then ready to be used to aerate the liquid in the bottle. It should be noted in FIG. 8 that the sleeve 176 positioned about the control arm 27 is in engagement with the plunger of valve 54 and is out of engagement with the plunger of valve 42. The position corresponds to that where the tubing is open to atmosphere as previously described with reference to FIG. 2.

When the user decides to pressurize or aerate the liquid in the bottle, the control arm 27 is pulled outwardly sliding in the sleeve 176. Although not evident in FIG. 8, it will be seen in FIG. 9 that the arm 27 has a square cross section and rides in an opening 194 having a main portion containing the control arm as shown in FIG. 9 and a smaller portion extending from the main portion. A broken line is used in FIG. 9 within the section lines covering the control arm 27 to indicate that the arm is notched at a location which is contained in the sleeve 176 in FIG. 8. After the arm has been pulled out sufficiently, it is possible to slide the arm sideways to engage the notch with a portion of the wall 180 adjacent the opening 194 as indicated in FIGS. 10 and 11. A comparison of FIGS. 10 and 11 will show that the sleeve 176 is now in engagement with the valve 42 so that this valve is open and the valve 54 is closed. As described with reference to FIG. 2, pressure is now available to the connector assembly 48 and aeration of the liquid has commenced with the sealing member 138 engaged inside the bottle neck. While this is taking place the indicator 30 shows to the user the extent of aeration and this is allowed to continue until the recommended level is reached.

Returning to FIG. 10, the control arm has been moved outwardly causing the plungers 192 to move away from one another and into engagement with extensions 196 of the shroud 78 (FIG. 3). It will be evident that the plungers 192 lock the shroud in position so that it is impossible to move the front portion 26 upwardly during the aeration process.

As soon as the user sees that aeration is complete, the control arm 27 is simply moved sideways towards the position shown in FIG. 8 and the springs 188 complete the movement back to the FIG. 8 position. The plungers are now withdrawn and the user can lift the movable front portion 26 to remove the bottle.

This simple control arm operation ensures that the user will find the structure simple to operate and, because the pressure of carbon dioxide is used to seal the bottle, there is no need for the user to apply excessive force. In fact, the only resistance to movement of the lever (apart from minimal friction) lies in the stressing of the springs 188. These springs are obviously chosen so that they are capable of returning the control arm without requiring undue force to stress the springs. The preferred embodiment of the structure is moulded from acrylonitrile butadiene styrene. Parts such as the shroud are of steel and the sealing member 138 is of elastomeric ethylene propylene.

The preferred embodiment has been described for the purposes of illustrating the invention and should not be used to limit the scope of the invention has defined in the attached claims.

What I claim as my invention is:

1. Structure for aerating a potable liquid in a container such as a bottle and the like, the structure comprising:

a rear portion;

a movable front portion;

traveller means coupling the front portion to the rear portion for vertical movement of the front portion between a lowered position for accommodating the container in the structure during aeration, and an elevated position providing access into the structure to place the container in the structure before aeration and to remove the container after aeration;

a connector assembly coupled to the front portion for engaging the container and operable by pneumatic pressure to seal the container during aeration;

tubing means for conveying carbon dioxide from a pressurized source to the connector assembly; and a controller coupled to the tubing means between the pressurized source and the connector means for selectively either directing pressurized carbon dioxide to the connector means with the container in place in the structure to thereby activate the connector assembly to seal the container and to contemporaneously aerate the liquid, or exhausting pressure build up in the connector means and container to permit removal of the container with the aerated liquid.

2. Structure as claimed in claim 1 in which the traveller means is movable relative to both the front and rear portions so that on elevating the front portion, the front portion moves initially relative to the traveller means and then the elevation is completed by moving both the traveller and the front portion relative to the rear portion.

3. Structure as claimed in claim 1 in which the connector assembly includes a sealing member having a tubular cylindrical portion exposed to the pressurized carbon dioxide when the controller is activated to direct carbon dioxide to the connector assembly to thereby seal the container during aeration.

4. Structure as claimed in claim 1 in which the controller comprises: a control arm projecting outwardly and movable from a first position in which the connector means is vented to atmosphere and a second position in which the connector means receives pressurized carbon dioxide, the control arm being moved from the first to the second position by initially pulling the arm outwardly and then sideways; means biasing the control arm inwardly towards the first position; means adapted to retain the arm in the second position during aeration; valve means coupled to the tubing means and operable by the control arm in the first position to vent the connector means and container, and operable by the control arm in the second position to pressurize the connector means and container for aerating the liquid.

5. Structure as claimed in claim 1 and further comprising an aeration indicator coupled to the tubing means and attached to the front portion, the indicator being operable by pressure of carbon dioxide in the container to demonstrate the level of aeration of the liquid.

6. Structure as claimed in claim 1 in which the connector means further comprises a delivery tube positioned to extend into the container during aeration and to deliver a conical spray of carbon dioxide into the container.

7. Structure as claimed in claim 6 in which the conical spray has a shape dictated by a generator consisting of a line extending from the point of issue of the spray to where the bottom and side wall of the container meet.

8. Structure as claimed in claim 1 in which the front portion includes a shroud for enveloping at least the sides of the container during aeration to limit possible damage caused by failure of a faulty container.

9. Structure as claimed in claim 8 in which the shroud and controller include means locking the movable front portion in the lowered position during aeration of the liquid.

10. A connector assembly for use in a structure for aerating a potable liquid in a container, the connector assembly comprising:

a sealing member having a tubular cylindrical portion defining inner and outer surfaces;

means retaining the sealing member in position, the retaining means defining an inlet for pressurized carbon dioxide, the inlet being in pneumatic communication with the inner surface of the sealing member for deflecting the cylindrical portion outwards so that said outer surface is forced into sealing engagement with the container;

a delivery tube coupled to the retaining means, the delivery tube being in pneumatic communication with the inlet to convey carbon dioxide from the inlet into the liquid;

said retaining means further defining an outlet for carbon dioxide and air from the container after aeration and before removal of the container from the structure.

11. A connector assembly as claimed in claim 10 in which the retaining means comprises first and second elements co-operating to retain the sealing element in position and separable to replace the sealing element.

12. A connector assembly as claimed in claim 10 in which the sealing element further includes a flange at an upper extremity of the cylindrical portion and in which the retaining means includes first and second elements co-operating to retain the flange between these elements and separable to replace the sealing element.

13. A connector assembly as claimed in claim 12 in which the delivery tube is threaded into said first element and in which the sealing member further includes a bottom wall, the delivery tube penetrating the bottom wall and having a washer in sealing engagement with the bottom wall.

14. A connector assembly as claimed in claim 10 and further comprising a spray head attached to a lower end of the delivery tube, the spray head defining a central downwardly-facing orifice and a spherical depression surrounding the orifice symmetrically to provide a conical spray pattern of carbon dioxide in the liquid.

15. A connector assembly as claimed in claim 10 in which the retaining means further defines a throttling bore which provides at least part of the pneumatic connection between the inlet and the delivery tube to ensure adequate pressure build up inside the tubular cylindrical portion of the sealing member during aeration.

16. A controller for use in a structure for aerating potable liquid in a container, the controller being adapted to be located between a source of pressurized carbon dioxide and a connector assembly which is adapted to seal the container when actuated by pneumatic pressure, the controller comprising: a control arm projecting outwardly and movable from a first position in which the connector means receives pressurized carbon dioxide, the control arm being moved from the first to the second position by initially pulling the arm outwardly and then sideways; means biasing the control arm inwardly towards the first position; means adapted to retain the arm in the second position during aeration; valve means operable by the control arm in the first position to vent the connector means and container, and operable by the control arm in the second position to pressurize the connector means and container for aerating the liquid.

17. Structure for use in aerating a potable liquid by feeding pressurized carbon dioxide into the liquid, the structure comprising:

a stationary rear portion;

a movable front portion coupled to the rear portion for movement vertically between a lowered position for covering a container placed in the structure and containing liquid for aeration, and an elevated position providing access for placing the container in the structure and for removing the container after aeration;

a connector assembly coupled to the movable front portion for engaging the container to seal the container during aeration, the connector assembly including a sealing member operable by the pressurized carbon dioxide to seal the container;

a delivery tube coupled to the connector assembly for extending into the liquid during aeration and delivering carbon dioxide to the liquid;

a controller coupled pneumatically to the connector assembly and adapted to receive pressurized carbon dioxide from a suitable source, the controller being selectively operable either to deliver pressurized carbon dioxide to the connector assembly and hence to the delivery tube for sealing the container and aerating the liquid, or to contain the carbon dioxide from the source and to permit de-pressurization of the container and connector assembly to permit removal of the container after the front portion has been elevated.

18. Structure as claimed in claim 17 in which the front portion further includes a safety shroud for enclosing the container and in which the controller and shroud define means for locking the shroud and front portion in the lowered position with the controller operable to aerate the liquid so that the front portion can not be elevated during aeration.

* * * * *